US006343663B1

(12) United States Patent
Hill et al.

(10) Patent No.: US 6,343,663 B1
(45) Date of Patent: Feb. 5, 2002

(54) HORIZONTAL BORING APPARATUS

(76) Inventors: Marvin E. Hill, 16557 Catawba Rd., Lockport, IL (US) 60441; Thomas J. Land, 5575 Ann Marie Dr., Oak Forest, IL (US) 60452

( * ) Notice: Subject to any disclaimer, the term of this patent is extended or adjusted under 35 U.S.C. 154(b) by 17 days.

(21) Appl. No.: 09/604,336

(22) Filed: Jun. 27, 2000

(51) Int. Cl.[7] ..... E21B 3/02
(52) U.S. Cl. ..... 175/162; 175/121; 173/188
(58) Field of Search ..... 175/162, 121, 175/52, 85, 92; 173/27, 184, 188, 31

(56) References Cited

U.S. PATENT DOCUMENTS

| | | | | |
|---|---|---|---|---|
| 1,885,295 A | * | 11/1932 | Robinson | 175/121 X |
| 4,436,455 A | * | 3/1984 | Vance | 405/303 |
| 5,158,146 A | * | 10/1992 | Fuller | 175/122 |
| 5,246,079 A | * | 9/1993 | Morret | 175/62 |
| 5,363,925 A | * | 11/1994 | Gallagher | 173/186 |
| 5,803,189 A | * | 9/1998 | Geldner | 175/113 |
| 5,810,101 A | * | 9/1998 | Caraway, Jr. et al. | 175/78 |
| 5,944,452 A | * | 8/1999 | Reinert, Sr. | 405/232 |

FOREIGN PATENT DOCUMENTS

| | | |
|---|---|---|
| DE | 3318552 | * 11/1984 |
| FR | 901461 | * 6/1962 |

* cited by examiner

*Primary Examiner*—Frank Tsay
(74) *Attorney, Agent, or Firm*—Emrich & Dithmar

(57) ABSTRACT

Apparatus for drilling a horizontal underground bore is adapted for attachment to an articulated arm, or boom, attached to conventional construction equipment such as a crawler excavator. The apparatus includes a hydraulic motor attached to an end of the articulated arm by a support frame which allows for vertical pivoting displacement of the hydraulic motor. A keyed shaft of the hydraulic motor is adapted for secure, fixed attachment to the shaft of an auger. The apparatus further includes a support/guide assembly having a generally flat, plate-like base member and an elongated, linear alignment trough attached to the upper surface of the base member. The base member is positioned on the ground adjacent to where the horizontal bore is to be formed. The trough is aligned along the intended direction of the bore and includes a casing end portion which is inserted into the soil where the bore is to begin and is aligned with the intended direction of the bore. The trough is adapted to receive an auger along the length thereof, with the auger urged along the length of the trough through its casing end portion and into the soil by the articulated arm. The bore is formed by rotation of the auger by the hydraulic motor while the hydraulic motor/auger combination is urged forward by the articulated arm. After a first auger section forms a first portion of the bore and is buried, a second auger section is positioned in the trough and connected at opposed ends to the first auger section and the hydraulic motor for increasing the length of the bore.

21 Claims, 4 Drawing Sheets

HORIZONTAL BORING APPARATUS

FIELD OF THE INVENTION

This invention relates generally to sub-surface soil removal such as employed in the construction industry, and is particularly directed to apparatus for forming a generally horizontal underground bore.

BACKGROUND OF THE INVENTION

Water lines, sanitary storm and utility ducts are typically installed by digging a trench, laying pipe in the trench, and back filling the trench. This is an acceptable approach in new construction where there are no structures or improvements such as driveways or streets. Where improvements are present, a strip-like portion is typically removed from the improvement to permit excavation and laying of the water line or other type of duct. The improvement must then be repaired or replaced, rendering this approach time-consuming and expensive. When a natural obstruction such as a tree is encountered, it frequently must be removed. This also is highly undesirable.

To avoid the time, work and expense of removing and then replacing the improvement as in current approaches, it would be desirable to form an underground bore beneath the improvement (or tree) and to place the water line in the thus formed bore which are most commonly used for underground telecommunications and power line installations. There are currently directional drilling machines capable of forming an underground bore which are most commonly used for underground telecommunications and power line installations. However, these directional drilling machines typically include a diesel engine, fuel tank, gear box and transmission, torque converter and hydraulic system, and are thus large, heavy and expensive. It is typically moved by a crane or hoist and incorporates a heavy, high strength frame which provides support for the aforementioned components. With accessories, even a small directional drilling machine may weigh as much as 7,000 lbs. and requires a skilled operator. Because of their size, weight, complexity and cost, directional drilling machines have not gained acceptance in laying of water lines and other underground services.

The present invention addresses the aforementioned limitations of the prior art by providing a horizontal boring apparatus which does not require its own power plant, it is easy to use, including installation and removal, is adapted for use with conventional construction equipment such as crawler excavators and large backhoe loaders having an articulated arm, and provides a low cost approach to forming underground horizontal bores.

OBJECTS AND SUMMARY OF THE INVENTION

Accordingly, it is an object of the present invention to provide a horizontal boring apparatus which is fast, is easily installed, operated and removed, is powered and maneuvered by a conventional construction vehicle, and is capable of forming highly linear horizontal bores of extended length.

It is another object of the present invention to form an underground horizontal bore such as for laying a utility service line without disturbing surface improvements and vegetation.

Yet another object of the present invention is to provide a lightweight, compact arrangement for drilling an underground horizontal bore which is positioned by an articulated arm such as on a crawler excavator and is powered by a hydraulic drive motor.

This invention contemplates an apparatus for forming a generally horizontal underground bore, the apparatus comprising a first auger; rotary drive means coupled to the auger for rotating the auger; support/guide means disposed on a generally flat, substantially horizontal portion of ground adjacent to where the underground bore is to be formed, and wherein the support/guide means is aligned with an intended direction of the underground bore; and positioning means for placing the auger and rotary drive means in engagement with and for displacing the auger and rotary drive means along the support/guide means with the auger in contact with the ground for forming a horizontal bore.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
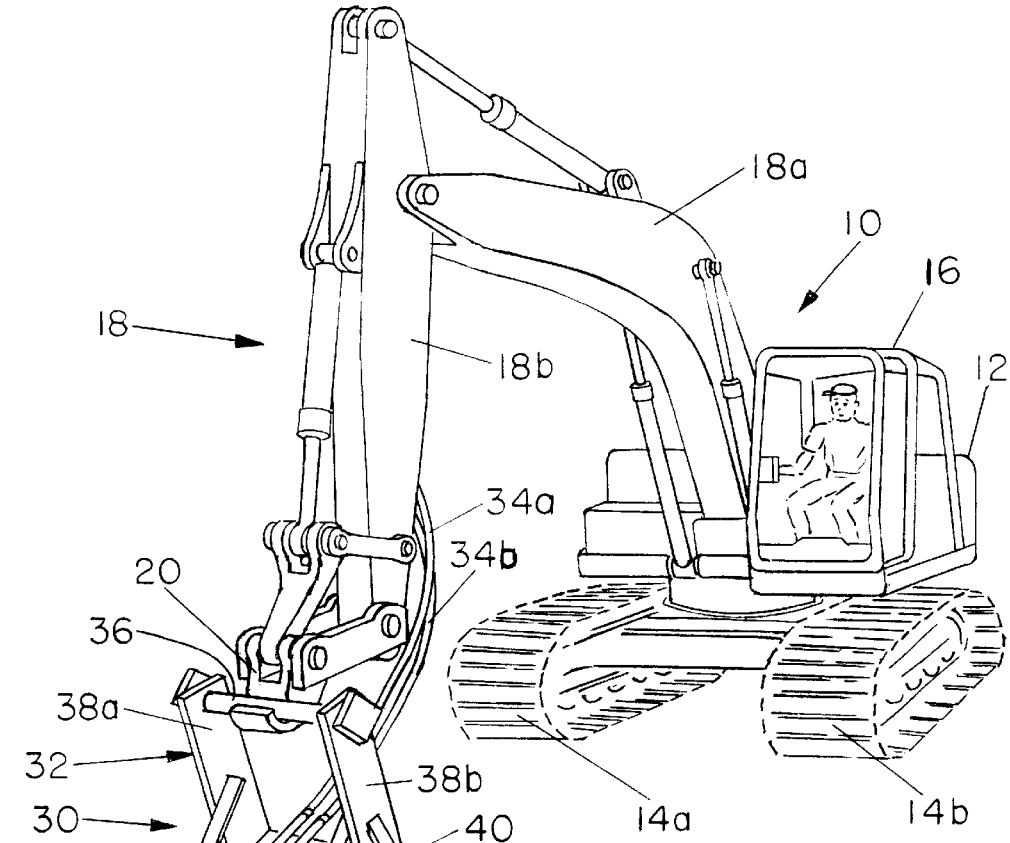
FIG. 1 is a perspective view of a portion of the horizontal boring apparatus of the present invention shown mounted to the articulated arm of a crawler excavator.

Referring to FIG. 1, there is shown a perspective view of a drive mechanism 30 of the horizontal boring apparatus of the present invention. Drive mechanism 30 is attached to the articulated arm 18 of a crawler excavator, sometimes referred to as a crawler excavator 10. The present invention may also be attached to an articulated arm mounted to various other construction vehicles, such as a large backhoe loader, although this is not shown for simplicity. Crawler excavator 10 is conventional in design and operation and includes a main frame 12 having an operator's station 16 in which the operator and appropriate controls (non shown for simplicity) are located. Attached to a lower portion of the main frame are first and second endless tracks 14*a* and 14*b* for propelling the crawler excavator 10. Articulated arm 18 is also conventional in design and operation and includes a proximal member 18*a* pivotally attached to a forward portion of the crawler excavator's main frame 12. Articulated arm 18 further includes a distal member 18*b* pivotally coupled to the arm's proximal member 18*a*. Proximal member 18*a* is moved relative to the crawler excavator's main frame 10 by means of a pair of hydraulic pistons, while the arm's distal member 18*b* is pivotally displaced relative to the arm's proximal member by means of a third hydraulic cylinder. Attached to the articulated arm's distal member 18*b* is a conventional adapter, or connector, 20.

In accordance with the present invention, drive mechanism 30 is attached to the distal end of articulated arm 18 by means of adapter 20. With reference to FIGS. 3, 4, 5 and 6 which are respectfully upper perspective, front elevation, side elevation and bottom plan views of the drive mechanism 30, the structure and operation of the drive mechanism will now be described. Drive mechanism 30 includes a support frame 32 and a hydraulic motor 46. Support frame 32 is preferably comprised of a high strength material such as steel and includes a pivot arm 36 connected to adapter 20. Support frame 32 further includes first and second frame members 38*a* and 38*b*. Pivot arm 36 is securely attached to respective first end portions of the first and second frame members 38*a* and 38*b*. Attached to second opposed ends of the first and second frame members 38*a* and 38*b* and aligned generally parallel with pivot arm 36 is a cross member 40. Also attached respectively to the first and second frame members 38*a*, 38*b* are third and fourth frame members 42*a* and 42*b*. Attached to cross member 40 are fifth and sixth frame members 44*a* and 44*b*. Distal ends of the third and fourth frame members 42*a*, 42*b* are respectively connected to the distal ends of the fifth and sixth frame members 44*a* and 44*b*. The third, fourth, fifth and sixth frame members 42*a*, 42*b* and 44*a* and 44*b* extend forward of the generally rectangular structure formed of pivot arm 36, cross member 40 and the first and second frame members 38*a* and 38*b*. The various connections between the above described frame members forming the support frame 32 are formed by conventional means, preferably by weldments, but also may be formed by nut and bolt combinations. The exception here is the connection between the pivot arm 36 and the first and second frame members 38*a*, 28*b*, wherein the pivot arm is inserted through apertures in respective ends of the first and second frame members so as to permit the support frame 32 to freely pivot on the pivot arm.

Support frame 32 further includes first and second angles 56*a* and 56*b* respectively attached to the frame's first and second frame members 38*a* and 38*b* as well as to the fifth and sixth frame members 44*a* and 44*b*. The first and second angles 56*a*, 56*b* are provided to increase the strength of the support frame 32. Lower portions of the fifth and sixth frame member 44*a*, 44*b* are each provided with plural, spaced first, second and third guide ribs. Thus, the fifth frame member 44*a* is provided with first, second, and third guide ribs 24*a*, 24*b* and 24*c*. Similarly, the sixth frame member 44*b* is provided with first, second and third guide ribs 26*a*, 26*b* and 26*c*. The guide ribs are adapted for engaging lateral edges of an alignment trough 66 in the support/guide assembly 66 as described in detail below. Attached to an aft portion of cross member 40 is a bracket 54 having an aperture 54*a* therein to facilitate lifting and moving the support frame 32 and hydraulic motor 46 combination when not in use.

Attached to the support frame 32 is a hydraulic motor 46. Hydraulic motor 46 is securely connected to fifth and sixth frame members 44*a*, and 44*b* and to the support frame's cross member 40 by conventional means such as weldments or mounting brackets using nut and bolt combinations. Hydraulic motor 46 is conventional in design and operation and is connected to a source of hydraulic pressure (not shown for simplicity) by means of first and second hydraulic connectors 52*a* and 52*b* and first and second hydraulic lines 34*a* and 34*b*. Extending from a forward portion of the hydraulic motor is a drive shaft 48 in a conventional manner. The application of hydraulic pressure to the hydraulic motor causes rotation of the drive shaft 48. Attached to the distal end of the rotary drive shaft 48 is an adapter 50 having a keyed aperture, or slot, 50*a* therein. Adapter 50 also includes a second aperture through which a removable connecting pin 28 is inserted for attaching an auger to drive shaft 48.

Figure 2:
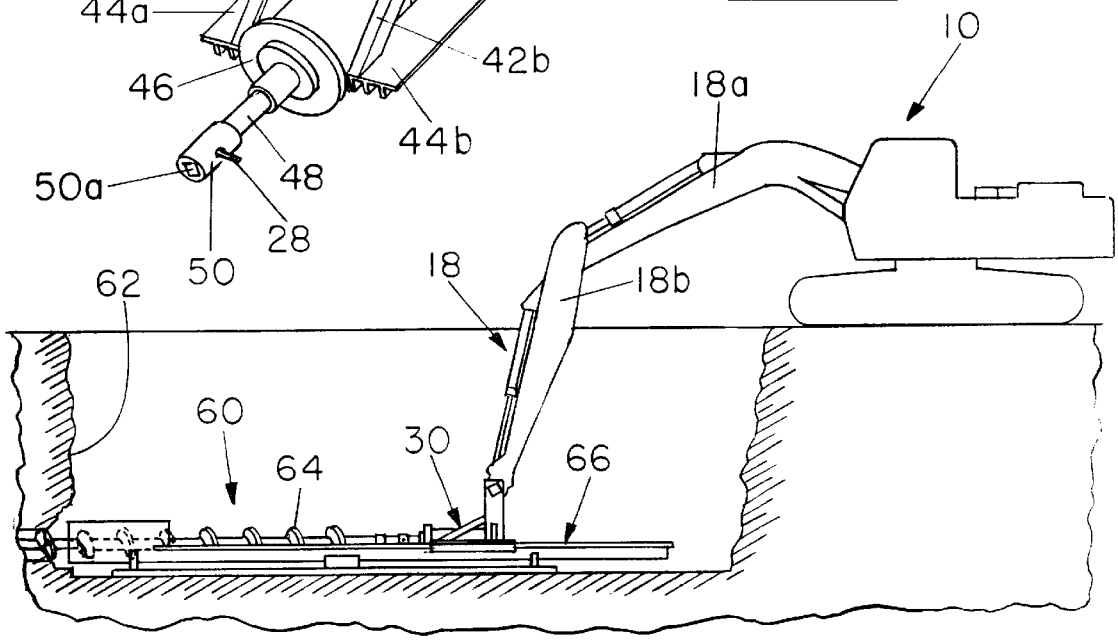
FIG. 2 is a side elevation view showing the horizontal boring apparatus of the present invention in position in an excavated hole for forming an underground horizontal bore.
Figure 3:
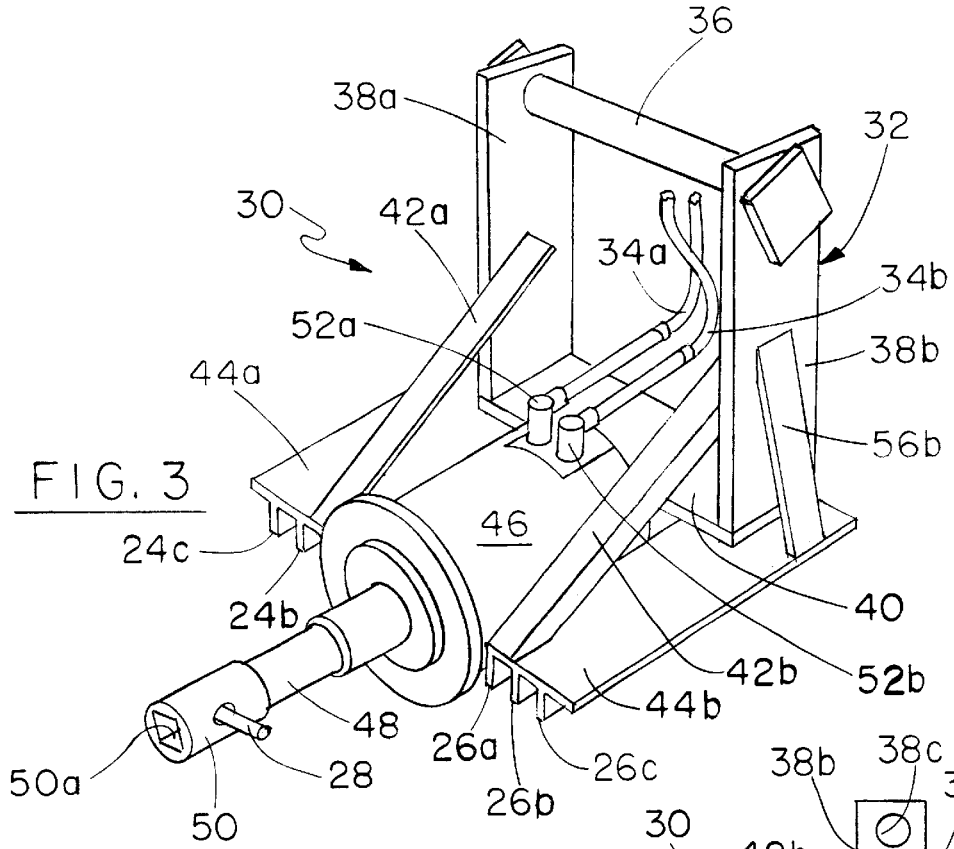
FIGS. 3, 4, 5 and 6 are respectively upper perspective, front elevation, side elevation, and bottom plan views of a hydraulic motor and support frame therefore which forms the portion of the horizontal boring apparatus of the present invention attached to the end of an articulated arm.
Figure 4:
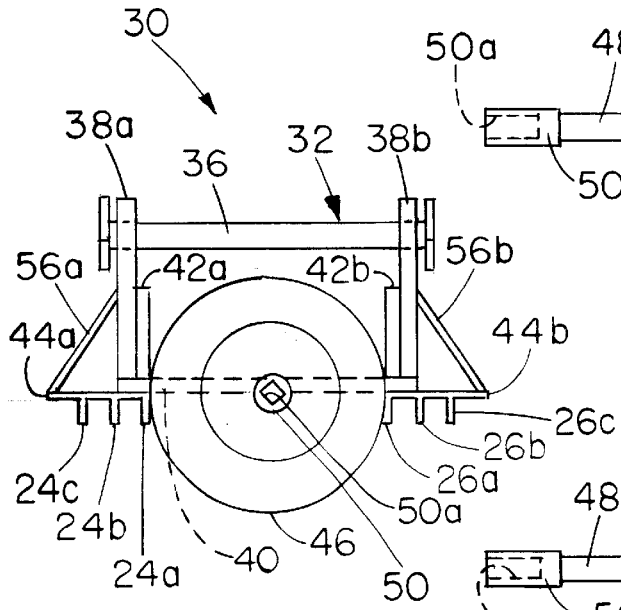
Figure 5:
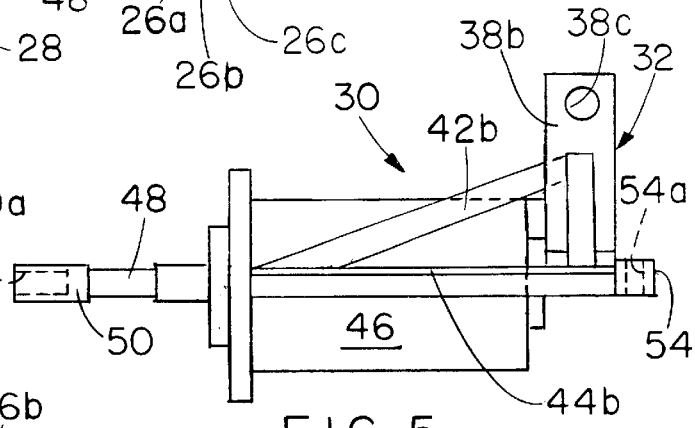
Figure 6:
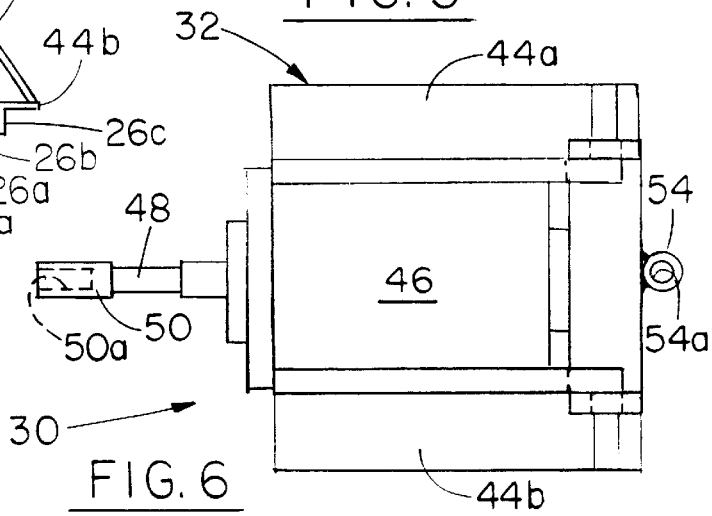

Referring to FIG. 2, there is shown a side elevation view of the inventive horizontal boring apparatus, including its drive mechanism 30 and support/guide assembly 60, in its operating configuration. As shown in the figure, the articulated arm 18 of the crawler excavator 10 extends into an excavated hole 62 in which the horizontal boring apparatus is disposed. As described earlier, the drive mechanism 30 is attached to the distal end of the crawler excavator's articulated arm 18. Drive mechanism 30 is positioned within an alignment trough 66 of the support/guide assembly 60 as described in greater detail below with reference to FIGS. 10 and 11 which are upper perspective views of the inventive horizontal boring apparatus. A casing end portion 68 of the alignment trough 66 is inserted into the soil of a wall of the excavated hole 62 in the direction and at the depth of the underground bore to be formed. Support/guide assembly 60 can be lowered into hole 62 and moved into position by means of the articulated arm 18 of the crawler excavator 10.

Figure 7:
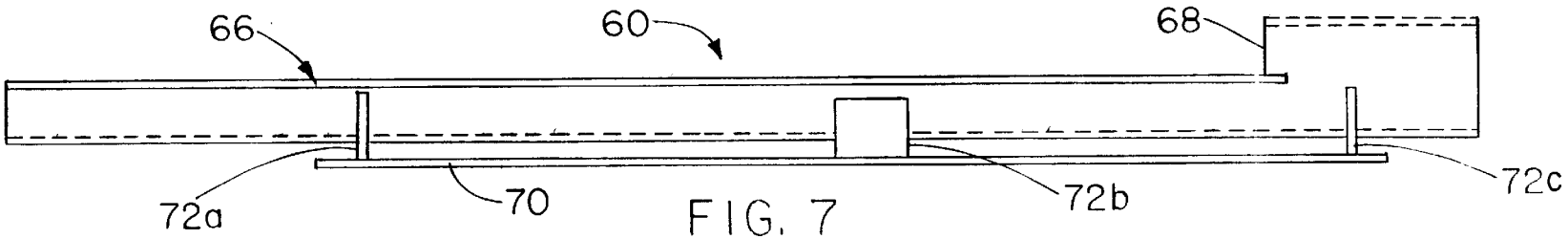
FIGS. 7, 8, and 9 are respectively side elevation, top plan and end-on views of an auger support/guide assembly used in the horizontal boring apparatus of the present invention.
Figure 8:
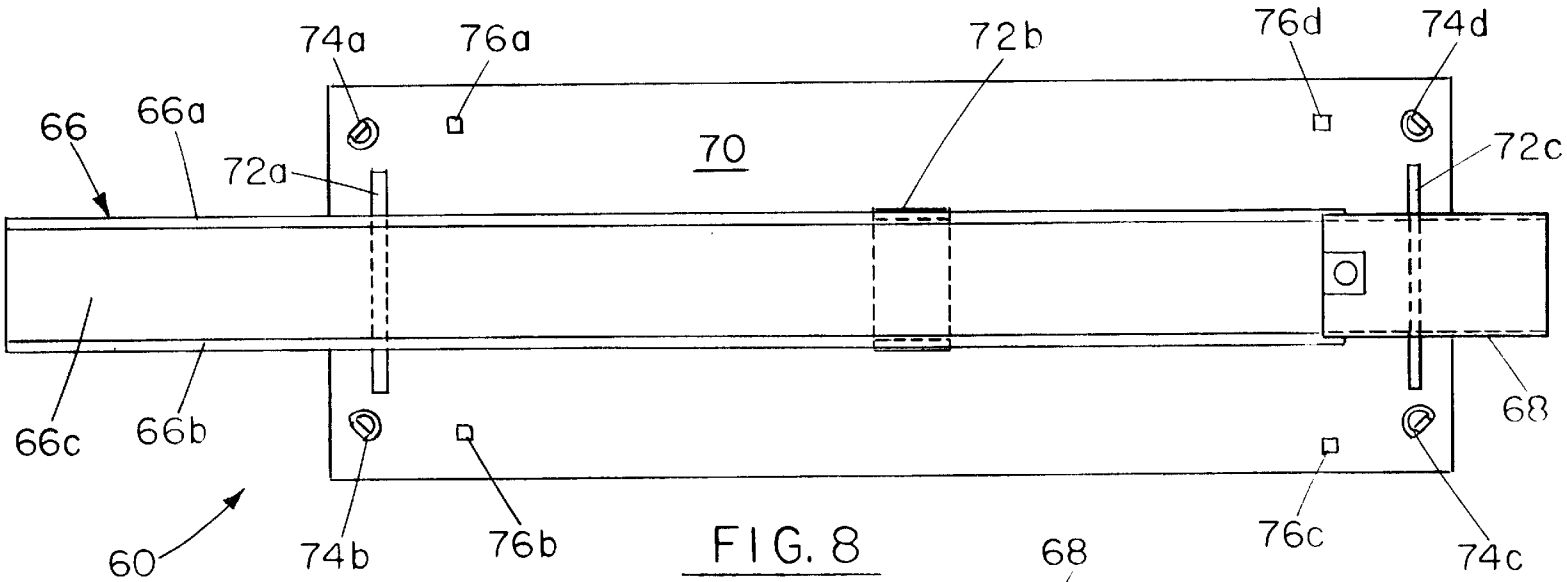
Figure 9:
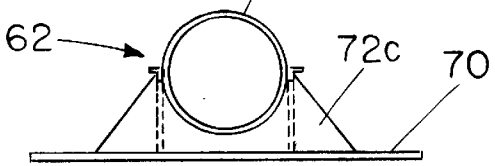
Figure 10:
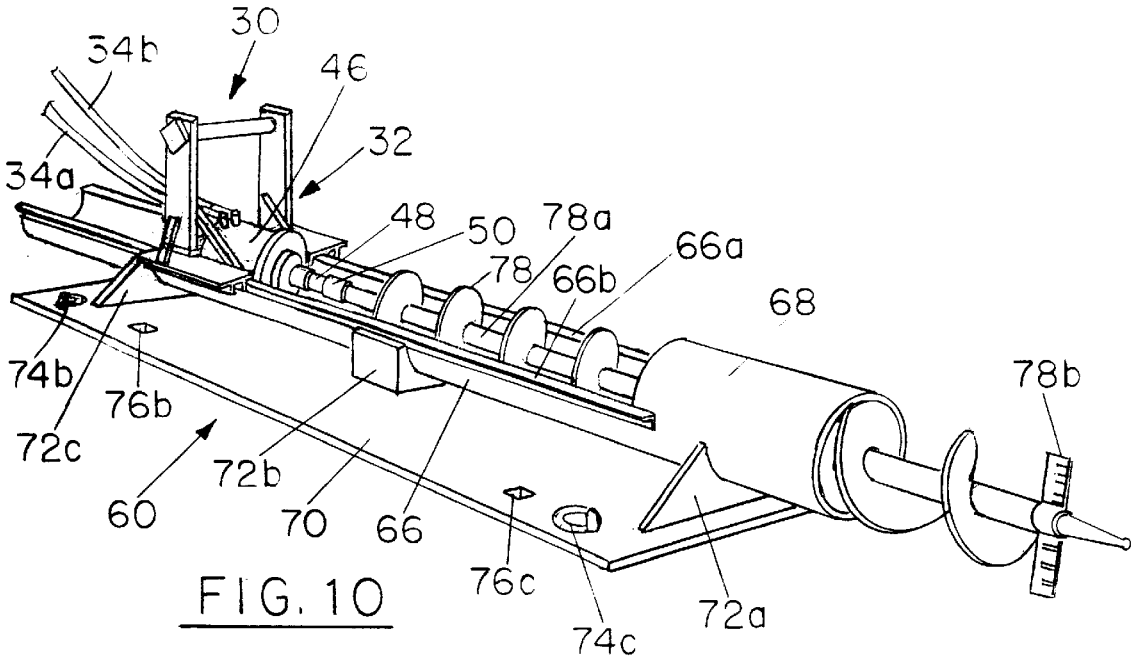
FIGS. 10 and 11 are upper perspective views of the horizontal boring apparatus of the present invention taken from different perspectives.
Figure 11:
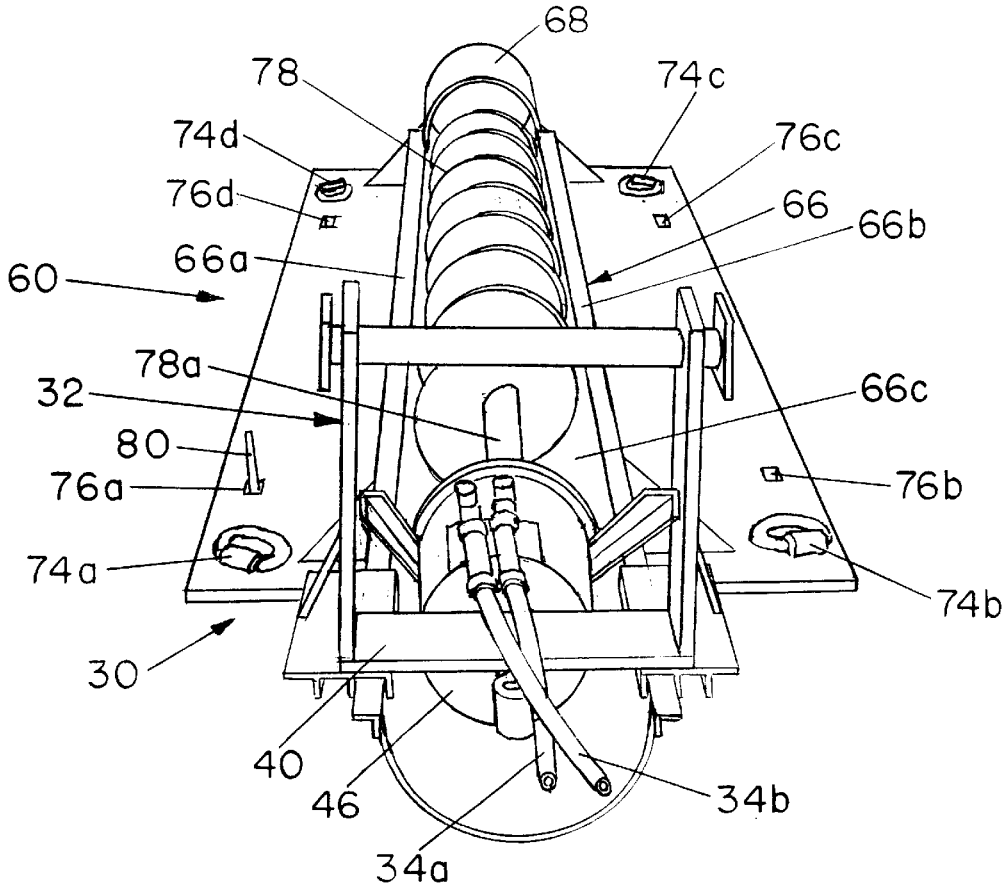

Details of the support/guide assembly 60 will now be described with reference to side elevation, top plan and end-on views of this portion of the invention shown in FIGS. 7, 8 and 9. FIGS. 10 and 11 also illustrate details of the invention discussed in the following paragraphs.

Support/guide assembly 60 includes a generally flat base member 70. Attached to the upper surface of base member 70 by means of a first, second and third mounting brackets 72*a*, 72*b* and 72*c* is an alignment trough 66. The first, second and third brackets 72*a*, 72*b* and 72*c* are securely attached to base member 70 and alignment trough 66 by conventional means such as weldments. First, second and third brackets 72*a*, 72*b* and 72*c* as well as base member 70 and alignment trough 66 are comprised of a high strength material such as steel. As shown in FIG. 2, when the horizontal boring apparatus is in use, base member 70 is typically disposed on a generally flat, horizontal section of soil. Base member 70 includes first, second, third, and fourth clasps 74*a*, 74*b* and 74*c* which are each adapted to receive a cable or other attachment device for lifting the support/guide assembly 60 for proper positioning for use or for removal after use. Base member 70 further includes first, second, third and fourth apertures 76*a*, 76*b*, 76*c* and 76*d* which are each adapted to receive a respective positioning member, as shown for the case of positioning member 80 inserted through aperture 76*a* in FIG. 11. Respective positioning members inserted through each of the apertures 76*a*–76*d* into the soil securely maintain the support/guide assembly 60 in a fixed position on the soil during drilling of the horizontal bore.

Alignment trough 66 is generally linear and semi-circular in cross section. Alignment trough 66 is adapted to receive an auger as shown for the case of auger 78 in FIGS. 10 and 11. Auger 78 includes an inner linear shaft 78*a* and a cutting head 78*b* disposed on the leading end of the auger's shaft. Rotation of auger 78 with its cutting head 78*b* urged into contact with the soil causes the cutting head to loosen and remove the soil which is displaced rearwardly by the spiral portion of the auger during formation of the bore. Alignment trough 66 is sized in both length and diameter to receive the auger 78 in a somewhat tight-fitting manner to permit the auger to rotate within the alignment trough while guiding the auger in direction during the boring operation. As described earlier, disposed on the perspective lower portions of the fifth and sixth frame members, 44*a*, 44*b* are plural guide ribs. Thus, the fifth frame member 44*a* is provided with first, second, and third guide ribs 24*a*, 24*b* and 24*c*, while the sixth frame member 44*b* is also provided with first, second and third guide ribs 26*a*, 26*b* and 26*c*. The spacing between the corresponding guide ribs on the fifth and sixth frame members 44*a*, 44*b* is such as to receive the opposed upper edges 66*a* and 66*b* of the alignment trough 66. Thus, the spacing between the gaps formed between guide ribs 24*a* and 24*b* allows the support frame 32 to be positioned on an alignment trough 66 having a given diameter. Similarly, with opposed upper edges of the alignment trough 66 positioned between the second and third guide ribs on the fifth and sixth frame members 44*a*, 44*b*, a larger diameter alignment trough may be accommodated for use with larger diameter augers. Finally, with the opposed upper edges of the alignment trough 66 disposed outside of and respectively engaging the third guide ribs 24*c* and 26*c* of the fifth and sixth frame members 44*a*, 44*b*, an even larger diameter alignment trough accommodating an even larger auger may be used with the support frame 32 of the drive mechanism 30. In one embodiment, the spacing between the first and second guide ribs is adapted to receive the upper edges of an alignment trough in which an auger having a diameter of 12 inches is positioned. Similarly, the spacing between the second and third guide groups on each of the fifth and sixth frame members 44*a*, 44*b* is such as to accommodate an alignment trough 66 in which an auger having a diameter of 16 inches is positioned. Finally, the third guide ribs on each of the fifth and sixth frame members 44*a*, 44*b* are spaced so as to accommodate an alignment trough 66 in which an auger having a diameter of 24 inches is positioned. These dimensions of the auger and alignment trough are given simply as an example, as the present is not limited to operating with augers of the listed diameters.

As described earlier, the casing end portion 68 of alignment trough 66 is inserted a few inches into the soil in which the bore is to be formed for the purpose of guiding the auger both horizontally and vertically during the boring operation. The horizontal boring apparatus operates in the following manner for forming a horizontal bore of extended length. A first auger section disposed in the alignment trough 66 is attached to the hydraulic motor 46 and is urged forward by the articulated arm 18. As the auger is rotated by the hydraulic motor 46, the auger forms a circular bore in the soil and the loosened soil is moved rearwardly by the flight portion of the auger. The loosened soil is deposited in or adjacent to the alignment trough 66 and must be periodically removed such as by means of a shovel. Once the first auger section is driven fully into the soil, a second auger section is positioned within the alignment trough 66. A leading end of the second auger section is attached to the aft end of the first auger section such as by a connecting pin with a keyed aperture coupling arrangement. The aft, or trailing, end of the second auger section is then inserted into the keyed aperture 50*a* of the adapter 50 on the end of the hydraulic motor's drive shaft 48 and is connected thereto by means of a connecting pin 28. The two connected auger sections are then rotationally displaced by the hydraulic motor 46 to further penetrate the soil until the second auger is also completely disposed within the soil. The loosened soil is then removed from the alignment trough 66 and the area adjacent to the alignment trough and a third auger section is positioned within the alignment trough 66 and is connected as previously described to the second auger section and hydraulic motor. In this manner, horizontal bores of extended length may be formed. Once the desired length of the bore is achieved, the drive mechanism 30 is removed from the end of the articulated arm 18. The distal end of the articulated arm 18 is then connected to the trailing end of the last inserted auger section such as by a cable, and the articulated arm pulls the connected auger sections rearwardly so as to expose the last attached auger section. This process continues until all of the auger sections have been removed from the bore and disconnected from an adjacent auger section.

There is thus been shown a horizontal boring apparatus which is adapted for use on the end of an articulated arm such as employed in various construction machines such as crawler excavators. The horizontal boring apparatus includes a drive mechanism having a hydraulic motor attached to the distal end of the articulated arm. The horizontal boring apparatus further includes a support/guide assembly which is positioned on the ground immediately adjacent to where the bore is to be formed. An auger section is connected to and rotated by the hydraulic motor while positioned in an alignment trough in the support/guide assembly to begin forming the horizontal bore. The hydraulic motor is then disconnected from the first auger section and another auger section is positioned in the alignment trough support/guide assembly and is connected to the first auger section as well as to the hydraulic motor. Rotation of both auger sections increases the length of the horizontal bore. The sequence is repeated using additional auger sections until the desired length bore is formed. The drive mechanism is then removed from the distal end of the articulated arm and the articulated arm is used to pull the auger sections from the bore such as by attaching a cable to the trailing end of each of the auger sections. The horizontal boring apparatus of the present invention is lightweight, compact and is easily installed, operated and removed from the thus formed horizontal bore.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. Apparatus for forming a generally horizontal underground bore, said apparatus comprising:

a first auger;

rotary drive means coupled to said auger for rotating said auger;

support/guide means disposed on a generally flat, substantially horizontal portion of ground adjacent to where the underground bore is to be formed, and wherein said support/guide means is aligned with an intended direction of the underground bore; and positioning means for placing said auger and rotary drive means in engagement with and for displacing said auger and rotary drive means along said support/guide means with said auger in contact with the ground for forming a horizontal bore.

2. The apparatus of claim 1 wherein said rotary drive means comprising a hydraulic motor.

3. The apparatus of claim 1 wherein said positioning means includes an articulated arm.

4. The apparatus of claim 3 further comprising coupling means for attaching said rotary drive means to an end of said articulated arm.

5. The apparatus of claim 4 wherein said articulated arm is mounted to a vehicle.

6. The apparatus of claim 5 wherein said vehicle is a crawler excavator or a backhoe loader.

7. The apparatus of claim 4 wherein said coupling means includes a support frame attached to said rotary drive means and pivotally coupled to the end of said articulated arm.

8. The apparatus of claim 7 further comprising an adapter pivotally coupling said support frame to the end of said articulated arm.

9. The apparatus of claim 7 wherein said support frame is disposed on and engages said support/guide means.

10. The apparatus of claim 9 wherein said support/guide means includes an elongated linear trough having an open upper portion and first and second spaced lateral edges disposed on respective sides of said open upper portion, and wherein said support frame is disposed on and displaced along said first and second spaced lateral edges by said positioning means.

11. The apparatus of claim 10 wherein said auger is disposed and displaced along said trough by said positioning means.

12. The apparatus of claim 11 wherein said support frame includes plural opposed spacers adapted to engage the first and second lateral edges of plural troughs each having a different width between said first and second lateral edges.

13. The apparatus of claim 12 wherein said spacers further include first and second pluralities of spaced ribs respectively disposed on opposed lateral portions of said support frame, wherein adjacent first ribs and adjacent second ribs are adapted to receive and engage the first and second lateral edges, respectfully, of said trough.

14. The apparatus of claim 11 wherein said support/guide means further includes a casing portion disposed on an end of said trough for engaging the ground where the underground bore is to be formed, and wherein said auger is displaced from said trough through said casing portion in forming the underground bore.

15. The apparatus of claim 14 wherein said casing portion is generally cylindrical.

16. The apparatus of claim 10 wherein said support/guide means further includes a generally flat base member disposed on the ground and coupled to and supporting said trough.

17. The apparatus of claim 16 further comprising plural coupling brackets for mounting said trough to an upper portion of said flat base member.

18. The apparatus of claim 17 wherein said base member includes at least one aperture therein, said apparatus further comprising at least one positioning member, wherein each positioning member is adapted for insertion through a respective aperture and into the ground for maintaining said support/guide means in fixed position on the ground.

19. The apparatus of claim 16 wherein said generally flat base member includes at least one clasp attached thereto for facilitating lifting and moving said support/guide means.

20. The apparatus of claim 1 wherein said trough is adapted to receive a second auger along the length thereof and wherein said second auger has first and second opposed ends respectfully adapted for coupling to said first auger and to said rotary drive means for increasing the length of the bore when said first and second augers are displaced by said rotary drive means.

21. Apparatus for forming a generally horizontal underground bore, said apparatus comprising:

an articulated arm;

a hydraulic motor;

a support frame for mounting said hydraulic motor to an end of said articulated arm;

an auger attached to and rotationally displaced by said hydraulic motor;

a support/guide arrangement for receiving and supporting said auger and said support frame, wherein said support/guide arrangement is oriented generally horizontal and is disposed adjacent an intended position of the bore in the ground and is aligned along an intended direction of the bore, and wherein said auger when rotationally displaced by said motor and urged forward by said articulated arm forms a generally horizontal underground bore.

* * * * *